US008596256B2

(12) United States Patent
McPherson

(10) Patent No.: US 8,596,256 B2
(45) Date of Patent: Dec. 3, 2013

(54) APPARATUS AND METHOD FOR RELEASABLY MOUNTING AN ACCESSORY TO AN OBJECT SUCH AS FOR RELEASABLY MOUNTING AN ARROW QUIVER TO AN ARCHERY BOW

(75) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 13/196,434

(22) Filed: Aug. 2, 2011

(65) Prior Publication Data

US 2011/0283982 A1 Nov. 24, 2011

Related U.S. Application Data

(63) Continuation of application No. 11/735,227, filed on Apr. 13, 2007, now Pat. No. 7,987,842.

(51) Int. Cl.
*F41B 5/06* (2006.01)
*F41B 5/14* (2006.01)

(52) U.S. Cl.
USPC ..... 124/86; 24/545; 224/916; 248/231.81

(58) Field of Classification Search
USPC ..... 124/1, 25.5, 25.7, 86; 224/916; 248/229.15, 229.16, 229.25, 229.26, 248/239.71, 239.81; 24/531, 545, 546, 547; 446/120
See application file for complete search history.

(56) References Cited

U.S. PATENT DOCUMENTS

| | | | | |
|---|---|---|---|---|
| 725,586 | A | | 4/1903 | Pool |
| 2,802,611 | A | | 8/1957 | Jenkins et al. |
| 3,116,730 | A | | 1/1964 | Tingley |
| 3,337,099 | A | | 8/1967 | Rose |
| 3,566,531 | A | * | 3/1971 | Hasel et al. ..... 446/120 |
| 4,156,496 | A | | 5/1979 | Stinson |
| 4,252,101 | A | | 2/1981 | Spitzke |
| 4,685,438 | A | | 8/1987 | Larson |
| 5,566,665 | A | | 10/1996 | Stinson |
| 5,772,166 | A | | 6/1998 | Adams |
| 5,983,468 | A | | 11/1999 | Evans et al. |
| 6,105,566 | A | | 8/2000 | Tiedemann |
| 6,598,275 | B1 | | 7/2003 | Kolody et al. |
| 6,672,299 | B2 | | 1/2004 | Proctor |
| 6,691,694 | B2 | | 2/2004 | Stinson |
| 6,845,765 | B1 | | 1/2005 | Allshouse et al. |
| 7,987,842 | B2 | | 8/2011 | McPherson |

* cited by examiner

*Primary Examiner* — John Ricci
(74) *Attorney, Agent, or Firm* — Vidas, Arrett & Steinkraus

(57) ABSTRACT

A releasable mount comprising two mounting posts that releasably engage into notches in the ends of a resilient, generally C-shaped bracket. The releasable mount is particularly useful to releasably mount an archery accessory such as an arrow quiver to an archery bow, tree or tree stand or the like. The arrow quiver may include a hood having an arrow retaining insert for receiving an arrow with a single-point or a 2-4 bladed broadhead. The quiver may also include an arrow gripper having a plurality of fingers whose sides define expandable oval slots between adjacent fingers into which the arrows are loaded.

19 Claims, 10 Drawing Sheets

APPARATUS AND METHOD FOR RELEASABLY MOUNTING AN ACCESSORY TO AN OBJECT SUCH AS FOR RELEASABLY MOUNTING AN ARROW QUIVER TO AN ARCHERY BOW

CROSS-REFERENCE TO RELATED APPLICATIONS

This application claims the benefit and is a continuation of U.S. application Ser. No. 11/735,227, filed Apr. 13, 2007, now U.S. Pat. No. 7,987,842, the entire contents of which is hereby incorporated herein by reference.

BACKGROUND OF THE INVENTION

1. Field of the Invention

This invention broadly relates to an apparatus and method for releasably mounting an accessory to an object. More particularly, one exemplary use of this invention relates to an apparatus and method for releasably mounting an accessory such as an arrow quiver to an archery bow.

2. Description of the Background Art

Presently there exist many types of devices designed to allow an accessory to be releasably mounted to an object. By way of example, in the field of archery, arrow quivers are commonly mounted to an archery bow. By being mounted to the bow, the arrow quiver allows the archer to safely carry several arrows along with the bow. When needed, the archer conveniently releases one of the arrows from the quiver and loads it in the bow for shooting. After shooting, another arrow may be conveniently released from the quiver and likewise loaded in the bow for the next shot. Conversely, if the archer decides not to take the shot, the previously loaded arrow may be conveniently returned to the quiver for safe transport.

Representative arrow quivers are disclosed in U.S. Pat. No. 6,105,566 to Tiedemann and U.S. Pat. Nos. 6,691,694, 5,566,665 and 4,156,496 to Stinson. The patent to Tiedemann discloses a relatively light weight dual-wire frame arrow quiver that mounts to the bow via an adjustable bracket that attaches to the sight mounting holes of the bow's handle whereas the patents to Stinson disclose a quiver having a detachable quick-release mounting arrangement that employs a slip fit of the quiver frame into a spring loaded latching bracket that is attached to the bow handle.

Another type of a quick release detachable quiver is disclosed in U.S. Pat. No. 6,845,765 to Allshouse. Allshouse's quiver includes two mounting lugs that releasably mount, with a slight interference fit twisting motion, onto corresponding edges of a mounting bracket block attached to the bow handle. Similar to Allshouse's quiver, the Bear Hug quiver likewise included a quiver-to-mounting-block arrangement that functioned with a slight interference fit between the mounting lugs of the quiver and the respective edges of the mounting block to hold the quiver in position on the bow. However, with continued use, the interference fit between the quiver and mounting block would sometimes become so loose that the quiver would no longer be attached firmly to the bow.

Finally, U.S. Pat. No. 6,672,299 to Proctor utilizes a quick disconnect quiver including two base members that are releasably mounted onto the bow in a spaced-apart manner. The spaced-apart base members each include a resilient elastomeric portion having grooves into which the arrows are releasably loaded. A broadhead cover is mounted to a pair of parallel rails. The rails are mounted into corresponding holes in the resilient elastomeric member with an interference fit with sufficient pressure and friction to preclude undesired sliding of the rails relative to the base members such that the broadhead cover is held in its protective position covering the broadheads of the arrows.

Notably, the aforementioned releasably-mounted arrow quivers include components composed of various elastomers intended to absorb vibrations and noise. Nevertheless, there still exists a need for improved releasably-mounted arrow quivers having a reduced mass to minimize noise and vibration when in use.

Therefore, it is an object of this invention to provide an apparatus and method which overcomes the aforementioned inadequacies of the prior art mounts that releasably mount an accessory to an object, such as releasably-mounted quiver designs, and which provides an improvement which is a significant contribution to the advancement of the prior art releasable mounts.

Another object of this invention is to provide an apparatus and method for holding a first object in position relative to a second object, comprising the steps of affixing a pair of mounting posts to the first object; affixing a bracket to the second object, the bracket having a pair of ends, each with notches; and inserting the mounting posts into the respective notches.

Another object of this invention is to provide an apparatus and method for mounting an arrow quiver to an archery bow, comprising the steps of affixing a pair of mounting posts to the quiver; affixing a bracket to the bow, the bracket having a pair of ends, each with notches; and inserting the mounting posts into the respective notches to releasably mount the quiver to the bow.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the subject invention relates to an apparatus and method to hold a first object in position relative to a second object. The operative structure of the present invention comprises two mounting posts that releasably engage into notches in the ends of a resilient, generally C-shaped bracket. With the first object including the mounting posts and with the second object including the notched bracket, or visa versa, the present invention allows the first object to be simply and positively attached to the second object. Moreover, the releasable engagement of the mounting posts into the notches of the bracket of the present invention may be done by hand, thereby obviating the need for any tools for releasably mounting the first object to the second object. Further, the mounting posts and bracket are lightweight and tightly mated to minimize the generation of noise.

Without departing from the spirit and scope of this invention, the invention may be employed in any application or industry in which it is desirous to releasably mount a first object to a second object. The first object may for example comprise an accessory that is releasably mounted to a primary second object. For example, the first object accessory may include an archery accessory such as an arrow quiver that is releasably mounted to the primary second object such as a bow, tree or tree stand or the like. More particularly, with the mounting posts of the invention comprising a component of the arrow quiver and with the notched bracket comprising a component that is affixed to the bow, tree, tree stand or other structure, or visa versa, the invention allows the quiver to be releasably mounted to the bow, tree, tree stand or other structure without the use of any tools and minimizes at least some damping of vibrations that might otherwise exist between the quiver and the bow, tree, tree stand or other structure.

According to the invention, the arrow quiver may include a hood having an arrow retaining insert for receiving an arrow with a single-point or a 2-4 bladed broadhead. The quiver may also include an arrow gripper having a plurality of fingers whose sides define expandable oval slots between adjacent fingers into which the arrows are loaded.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE SEVERAL VIEWS OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENTS OF THE INVENTION

Figure 1:
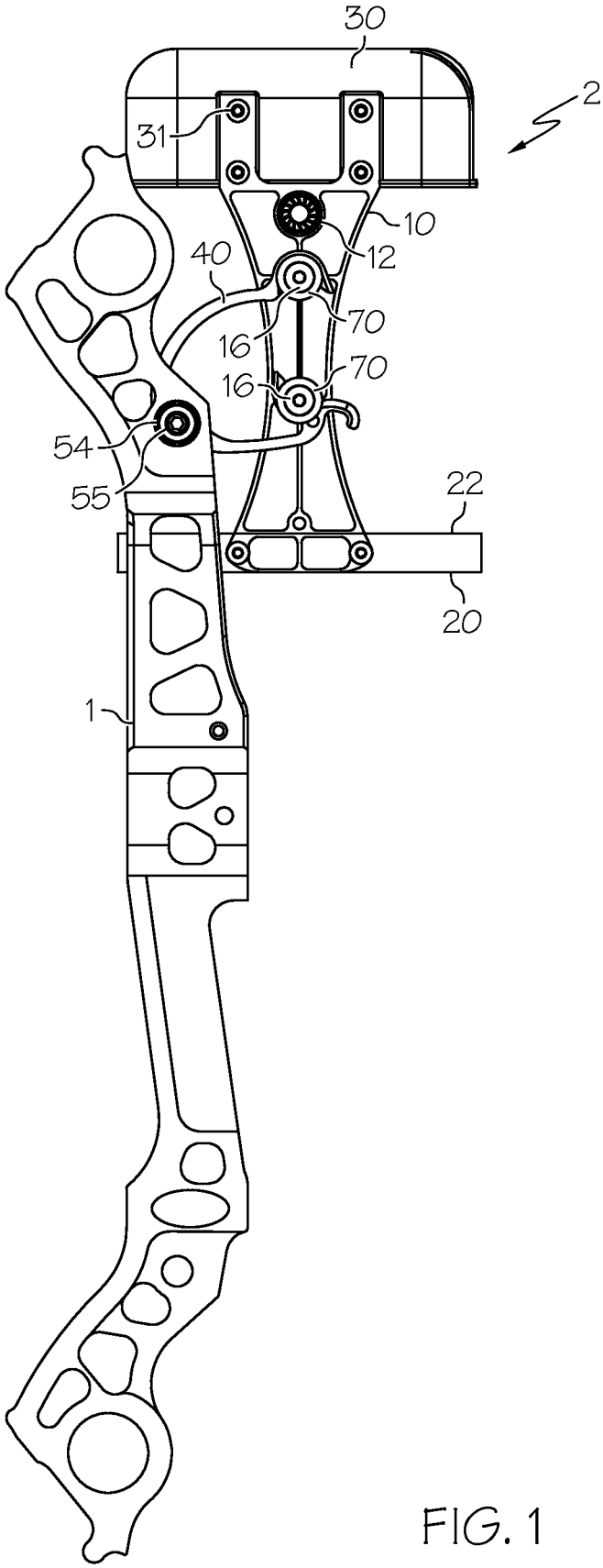
FIG. 1 is a left side view of a typical bow handle including the releasable mount of the present invention employed for releasably mounting a quiver onto the bow handle.

Referring to FIG. 1, the first embodiment of the releasable mount of this invention is incorporated into an arrow quiver 2 which may comprise a hood 30, main framework 10 and arrow holder items 20 and 22. The framework 10 preferably comprises a lightweight, spaced framework design machined or cast from a relatively rigid material. However, the framework 10 may comprise other designs such as an I-beam construction. A vibration damper 12 may be mounted within the framework 10; more specifically, the framework 10 preferably includes an opening that is designed to hold securely a harmonic damping device 12 (see FIG. 4 and FIG. 5).

Figure 10:
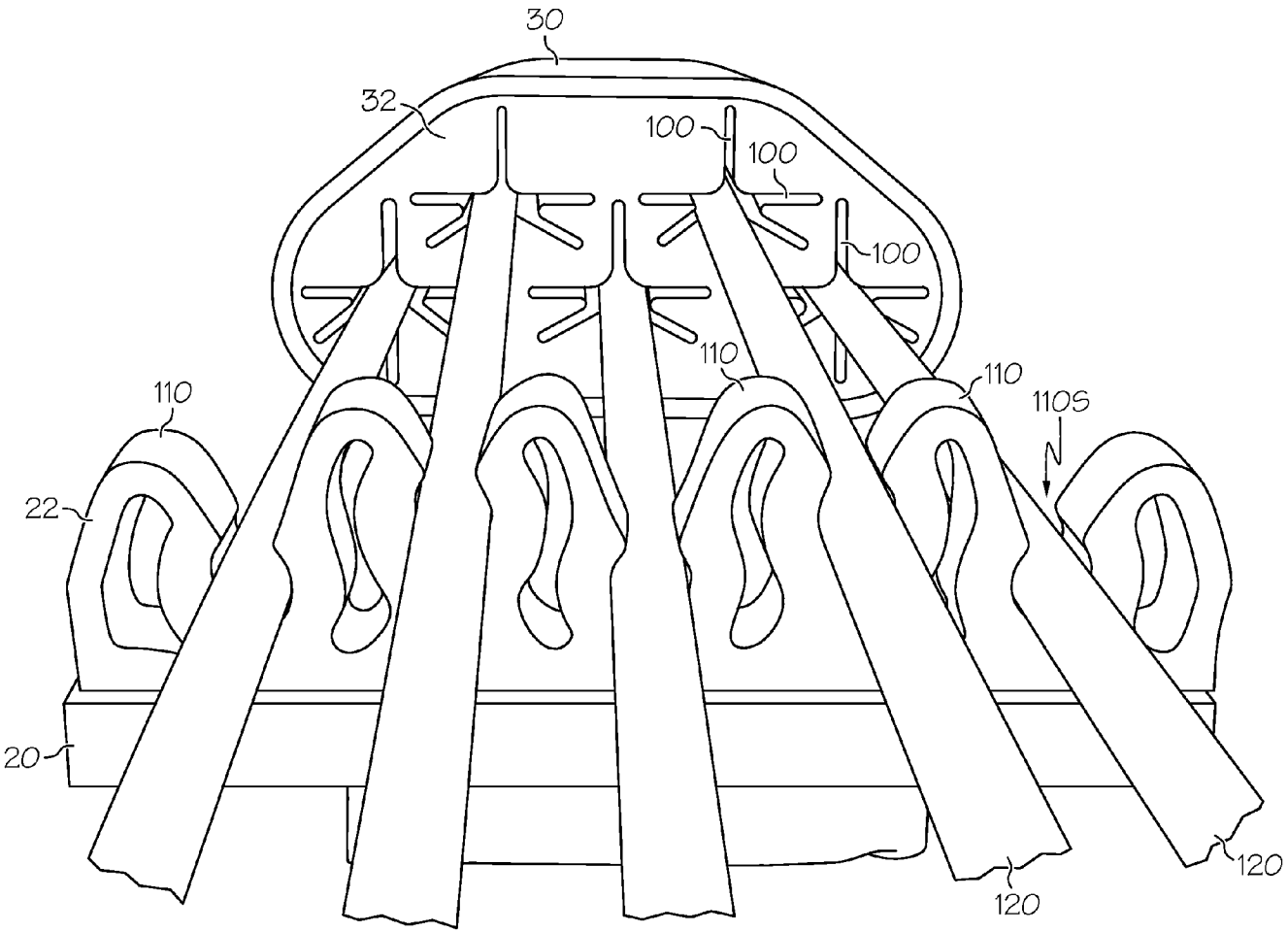
FIG. 10 is a partial longitudinal perspective view of the quiver showing a plurality of sample arrows whose broadheads are inserted into slots in the arrow retaining insert of the hood and whose shafts are snapped into slots formed in the arrow gripper.

As best shown in FIG. 10, the hood 30 of the quiver 2 preferably includes an arrow retaining insert 32, preferably composed of a foam material, with arrowhead slots 100 formed therein. As also best shown in FIG. 10, the arrow gripper 22 of the quiver 2 preferably includes a plurality of fingers 110 whose sides define expandable oval slots 1105 between adjacent fingers 110 into which the arrows 120 are loaded.

Figure 11:
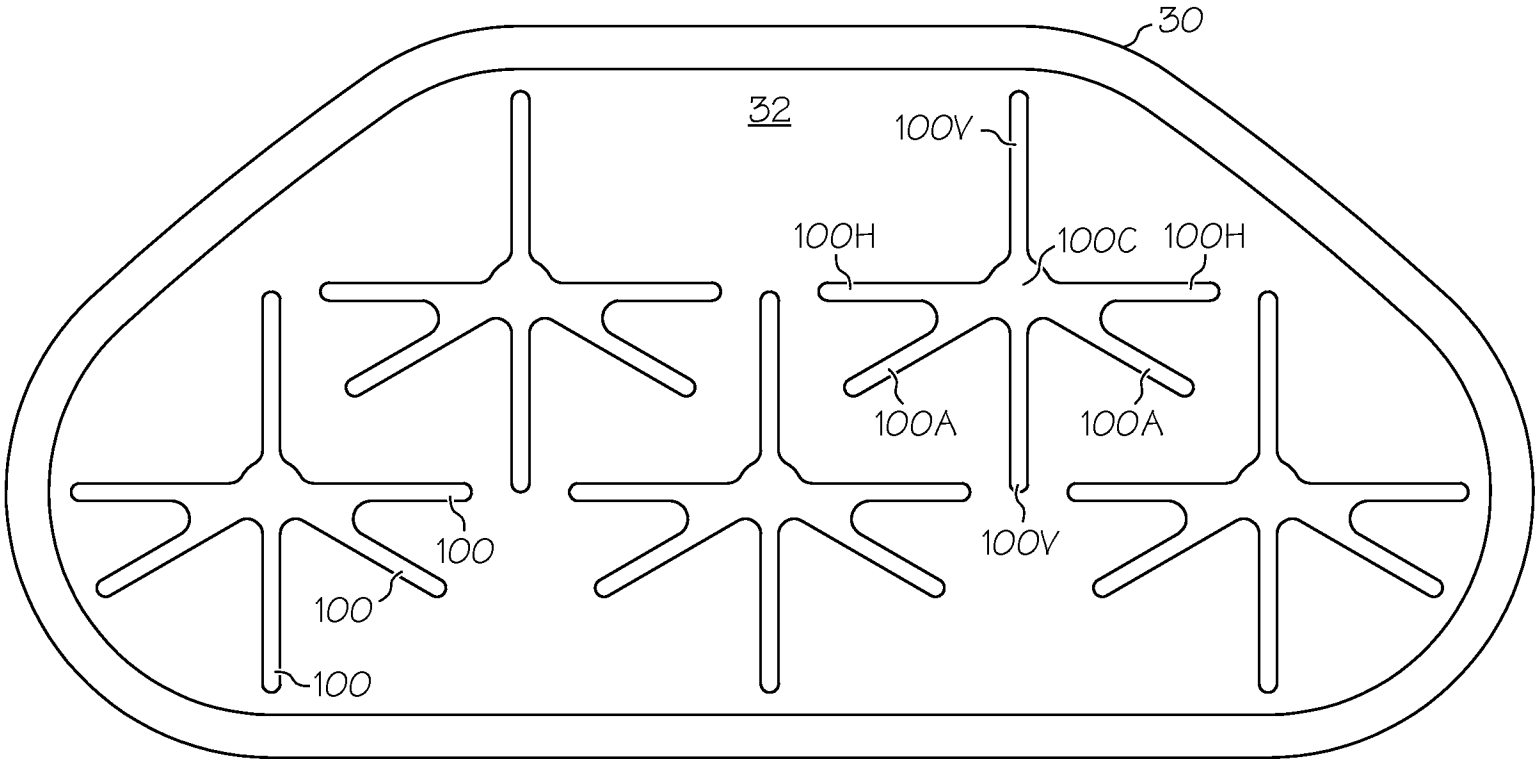
FIG. 11 is an enlarged perspective view of the hood showing the configuration of the slots formed in the arrow retaining insert for receiving arrows with single points, 2-bladed broadheads, 3-bladed broadheads and 4-bladed broadheads.

Referring to FIG. 11 which is an enlarged perspective view of the hood 30 and arrow retaining insert 32, the arrowhead slots 100 are formed in the foam material of the insert 32, such a by cutting, for receiving the tips of the arrows loaded into the quiver 2. Each arrowhead slot 100 comprises a star pattern comprising a center portion 100C with radial opposing vertical portions 100V, radial opposing horizontal portions 100H and radial angled portions 100A. The center portion 100C is dimensioned to receive a single-point tip of an arrow; the opposing vertical portions 100V (and opposing horizontal portions 100H) are dimensioned to receive a 2-bladed broadhead; the angled portions 100A combined with the opposing half of the vertical portion 100V (forming radial slot portions positioned at 120 degrees) are dimensioned to receive 3-bladed broadheads; and the opposing vertical portions 110V combined with the opposing horizontal portions 110H are designed to receive 4-bladed broadheads (see FIG. 10).

Figure 12:
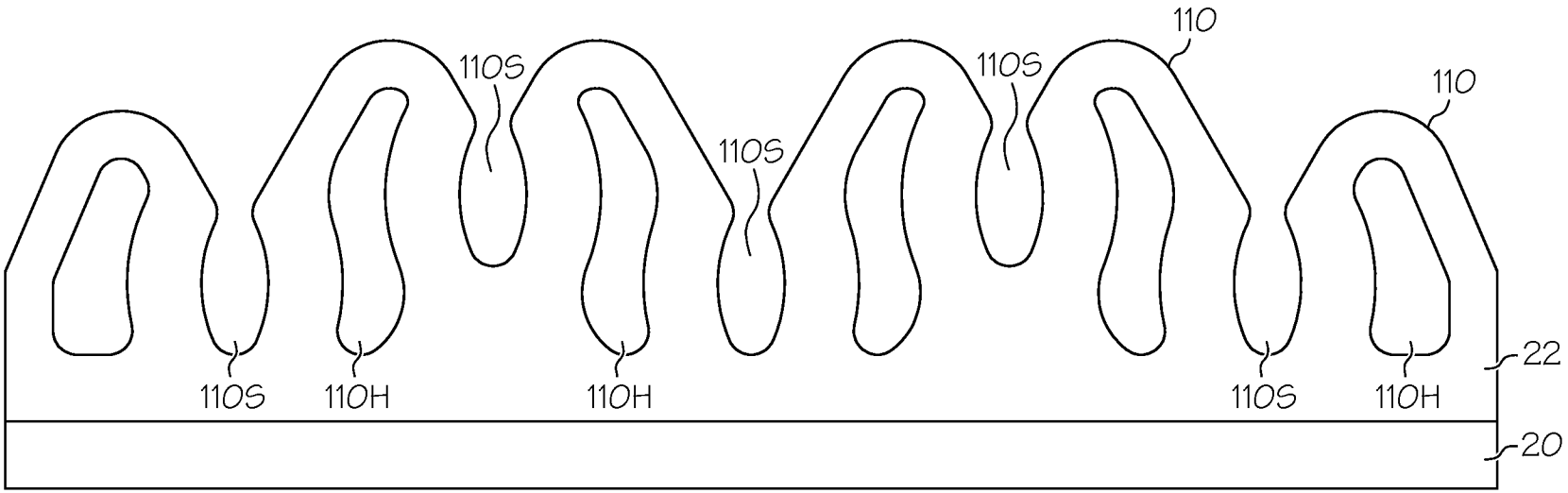
FIG. 12 is an enlarged end view of the arrow gripper showing the cross-sectional configuration of the slots formed in the arrow gripper.

Referring to FIG. 12, the plurality of fingers 110 of the arrow gripper 22 are configured to define expandable oval slots 110S between adjacent fingers 110 into which the arrows are to be loaded. The expandable oval slots 110S are staggered vertically such that no expandable oval slot 110S is at the same depth as its adjacent expandable oval slots 110S. The expandability of the oval slots 110S is achieved by forming each of the fingers 110 with a central hollow space 110H that allows, as best shown in FIG. 12, the finger's sides to collapse inwardly when an arrow is loaded into the oval slots 110S between adjacent fingers 100.

The quiver 2 as shown is one example of a particular quiver hood 30 with arrow retaining insert 32 and arrow gripper 22 and its attachment means 20 attached to the main quiver mounting frame 10. It should be appreciated, without departing from the spirit and scope of this invention, that other quiver hood and arrow gripper arrangements could be mated to the frame 10 without changing the intent or scope of this quiver attachment concept.

The releasable mount of the invention comprises paired mounting posts 70 and a generally C-shaped mounting bracket 40 having paired notches 44 and 46 for releasably receiving the respective posts 70. The mounting posts 70 are affixed to the main framework 10 of the quiver 2, preferably by threaded attached to the upper and lower portions of the framework 10 such as by using capscrews 16. The mounting bracket 40 is affixed to the bow handle 1.

Figure 2:
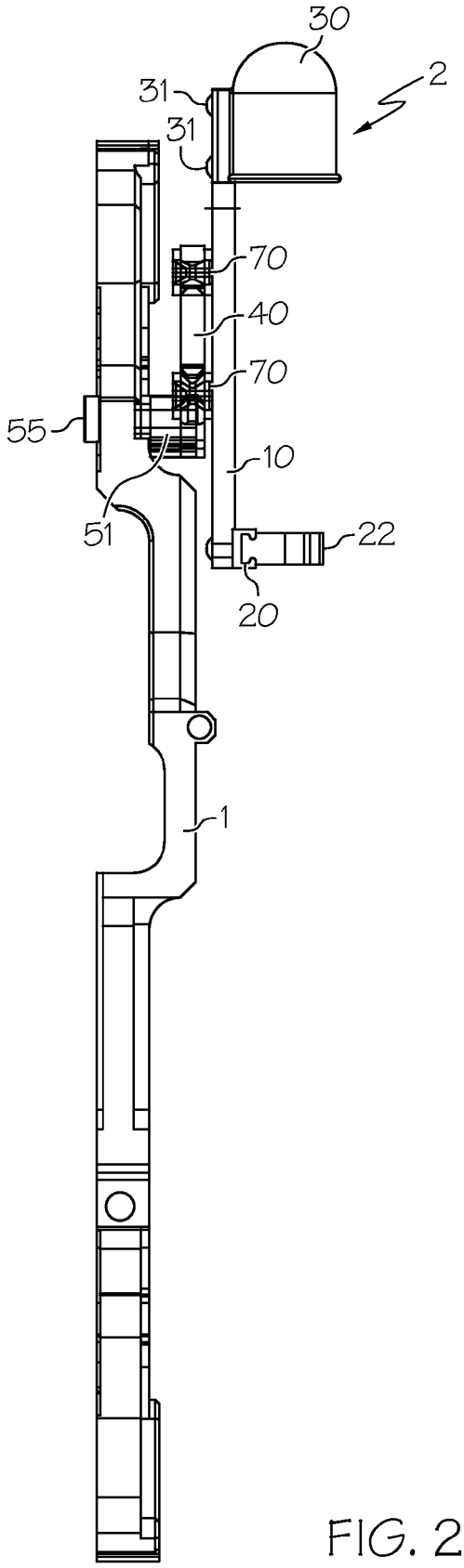
FIG. 2 is a front view of FIG. 1 taken from the shooting position showing the quiver releasably mounted to the bow handle.
Figure 3:
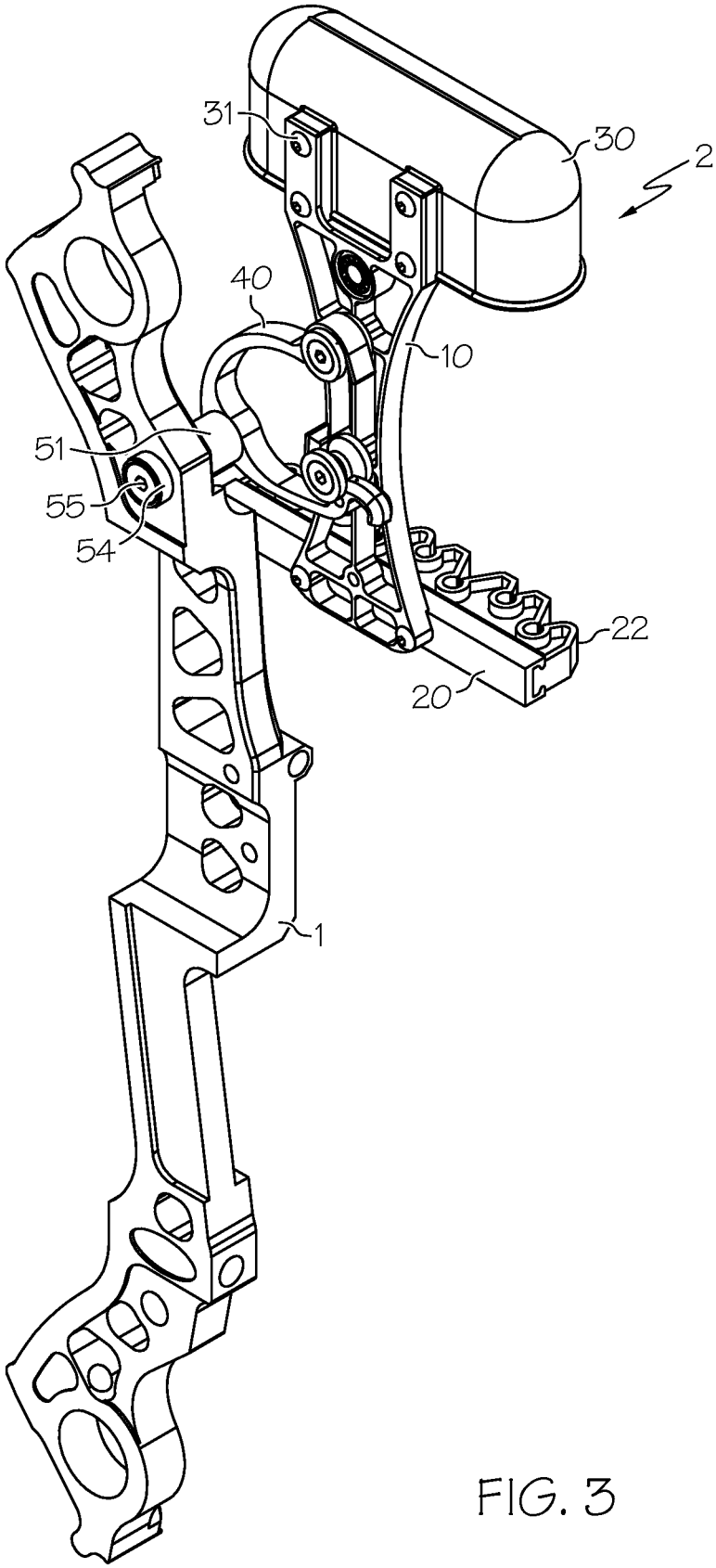
FIG. 3 is an upper left-side rear elevational view of FIG. 1.
Figure 4:
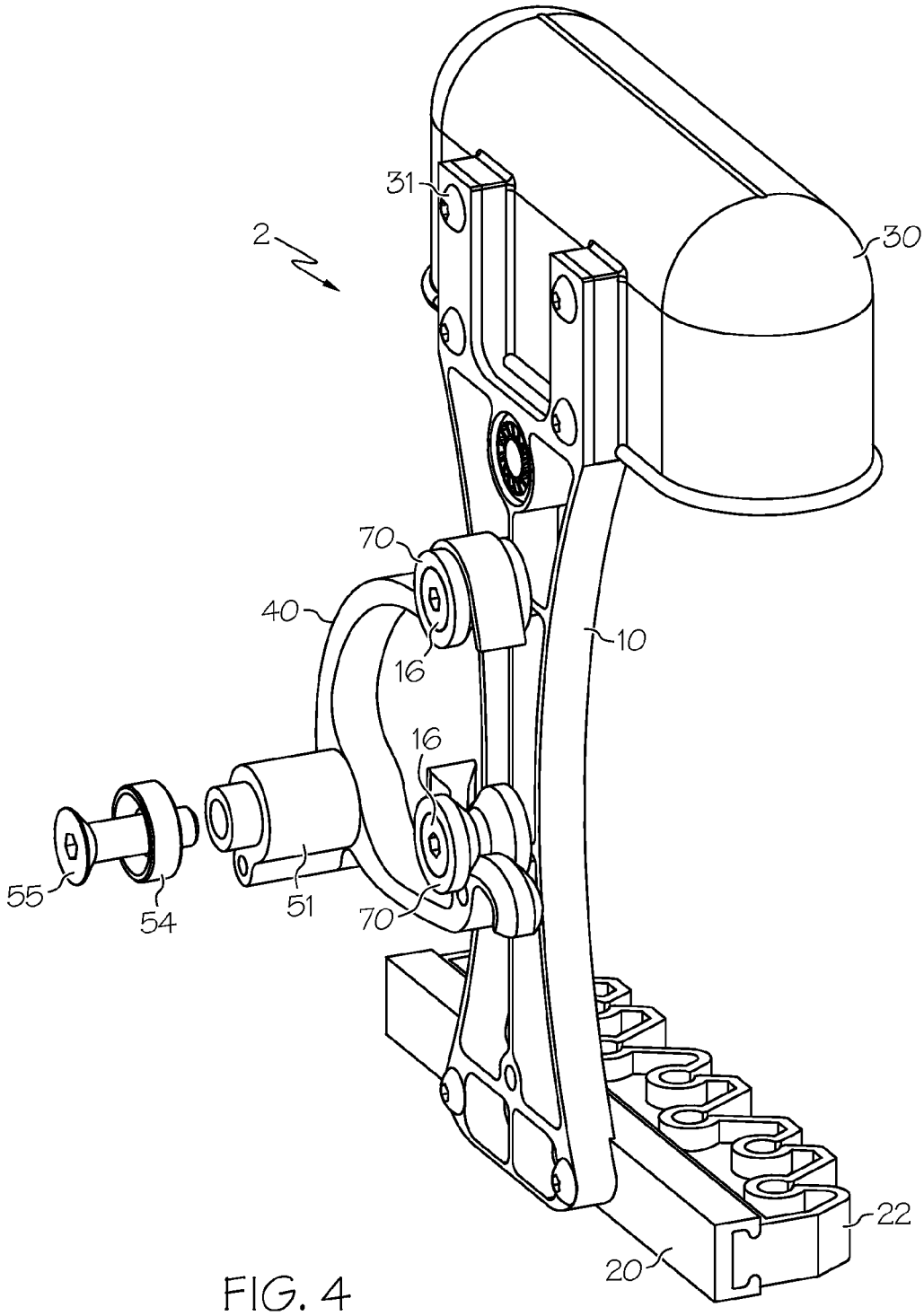
FIG. 4 is a partially exploded upper left-side rear elevational view of the quiver incorporating the mounting post of the releasable mount of the invention.
Figure 5:
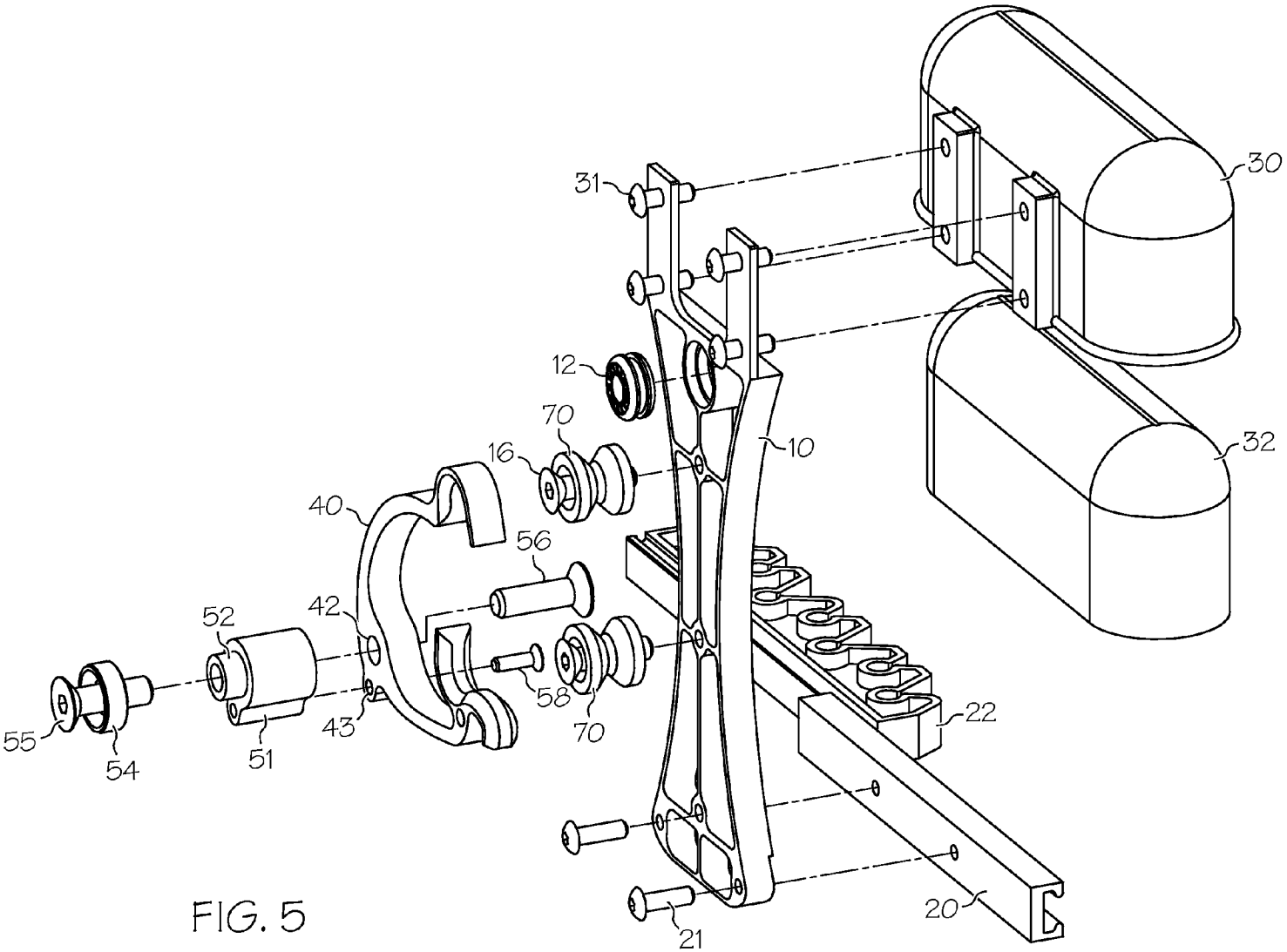
FIG. 5 is a fully exploded upper left-side rear elevational view of the quiver incorporating the mounting posts of the releasable mount of the invention.

As better shown in FIG. 4, the mounting bracket 40 is affixed to the bow handle 1 using a standoff 51 with a compression washer 54 and capscrew 55. The standoff 51 functions to properly position and space the mounting bracket 40 with respect to the handle 1 (see relative alignment of FIG. 2 and FIG. 3). As shown in FIG. 5, the periphery of the standoff 51 preferably includes a general keyhole shape with a pilot 52. A mounting hole of this same shape 52 is correspondingly machined into the bow handle 1 such that the standoff 51 slips fit into the mounting hole. When the compression washer 54 is placed against the opposite side of the handle 1 and capscrew 55 is placed through the handle 1 and threadably engaged to the standoff 51 to be tightened securely, the standoff 51 is non-rotationally securely mounted to the handle 1 and is thereby precluded from any rotational or twisting movement motion that might otherwise occur when twisting moments are applied to the quiver 2. The mounting bracket 40 is then preferably secured to the standoff 51 with capscrew 56 and capscrew 58 which pass through mounting holes 42 and 43 respectively and are threaded into corresponding tapped holes in the standoff 51. Attaching the mounting bracket 40 in this manner orients the bracket properly and secures the bracket 40 against any twisting moments that may be applied while attaching or removing the bow quiver 2.

It should be apparent to anyone skilled in the art that the standoff 51 could have a peripheral shape of some other regular or irregular profile so long as it matched and mated with a similar profile in the bow handle 1 such that when the two were assembled together the standoff would be capable of resisting a twisting moment about the pilot 52 of the standoff 51.

The releasable mount of the invention provides positive attachment of the quiver 2 to the bow 1 by virtue of notches 44 and 46 formed in the ends of the C-shaped arms of the mounting bracket 40 in which the mounting posts 70 are releasably received and grasped. For mounting, the mounting bracket 40 may be sprung to accept and grasp the mounting posts 70 in its notches 44 and 46. For release, the mounting bracket 40 may be sprung whereupon the mounting posts 70 may be released from the grip of the notches 44 and 46.

Figure 7:
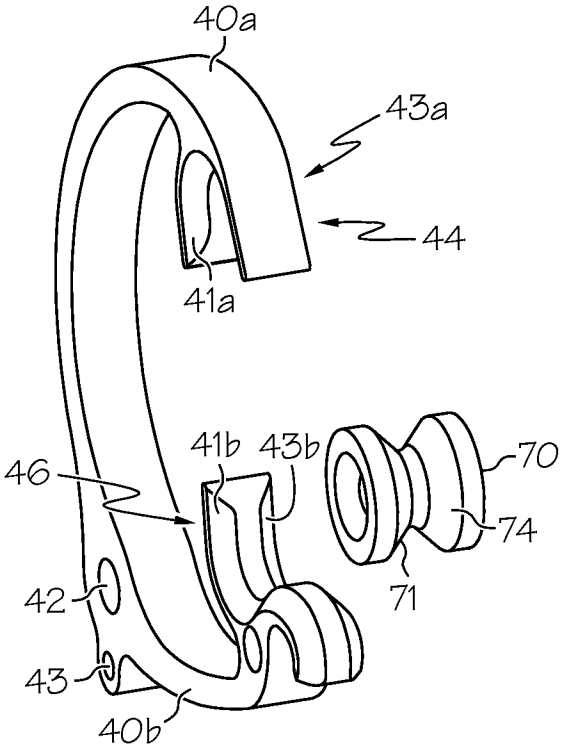
FIG. 7 is another elevational view of the first embodiment of the notched bracket of the releasable mount of the invention showing one of the mounting posts in alignment for releasable engagement into the lower notch of the notched bracket.
Figure 6:
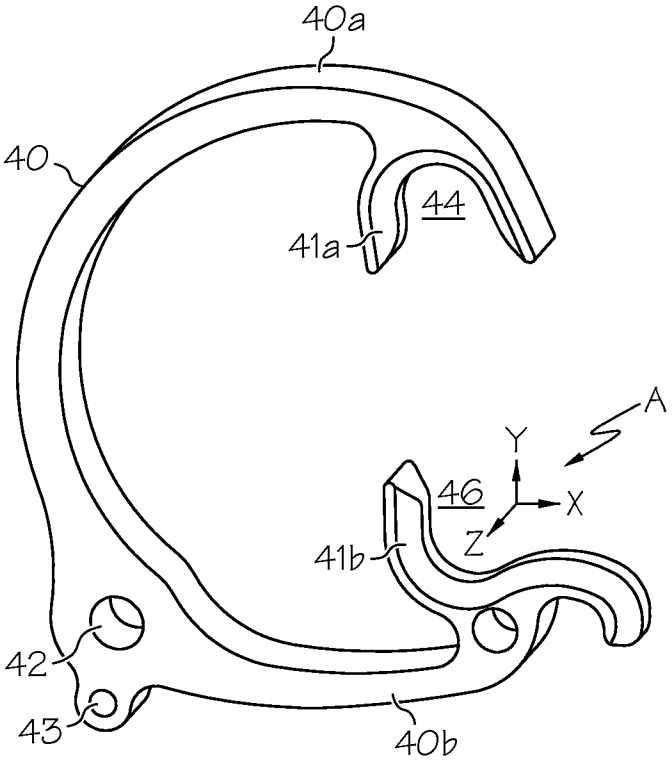
FIG. 6 is an elevational view of the first embodiment of the notched bracket of the releasable mount of the invention in which the notches face toward each other to exert an inward force on the mounting posts when they are releasably mounted therein.

In the first embodiment shown in FIGS. 6 and 7, the notches 44 and 46 of respective upper arm 40*a* and lower arm 40*b* of the bracket 40 face each other and include male side wedging surfaces 41*a* & 43*a* and 41*b* & 43*b*, respectively, that mate with the female tapered (wedge) surfaces 71 and 74 of the respective mounting posts 70. As best shown in FIG. 6, the respective notches 44 and 46 of the mounting bracket 40 retain the mounting posts 70 from movement in each of the X, Y and Z directions (as shown in View "A") with an appreciable degree of force due to the spring force exerted thereby and the tapered fits of the female tapered (wedge) surfaces 71 and 74 of the mounting posts 70 matching the tapered fits of the male side wedging surfaces 41*a* & 43*a* and 41*b* & 43*b* of the notches 44 and 46. This positive surface-to-surface contact precludes any movement between these two components due to shock or vibration and any noise generation at the point of attachment.

As best shown in FIG. 7, the bow quiver 2 (with the mounting posts 70) is attached to the mounting bracket 40 (previously secured to the bow handle 1) by inserting the upper mounting post 70 into the upper notch 44 and with the lower mounting post 70 aligned with the lower notch 46 (see View "A" of FIG. 6). The quiver 2 is rotated (clockwise relative to FIGS. 6 and 7) to mate the surfaces 71 and 74 of the lower post 70 in contact with surfaces 41*b* and 43*b* of the lower notch 46 of the end of the mounting bracket arm 40*b*. Upon rotation, the lower post 70 engages the cam portion of the lower notch 46 of the lower arm 40*b*. As the quiver 2 continues to be rotated clockwise, the upper 40*a* and lower 40*b* arms are forced apart. Then, once the lower mounting post 70 reaches its seated location in the lower notch 46 in the lower arm 40*b* (see View "A"), a constant tension is exerted by the two notches 44 and 46 of the respective arms 40*a* and 40*b* (generated by the inherent memory of the resilient material constituting the bracket 40 acting on the facing notches 44 and 46) onto the posts 70 to securely retain them in the respective notches 44 and 46 of the mounting bracket 40. The quiver 2 is therefore securely mounted, via the mounting bracket 40, to the bow 1.

Figure 8:
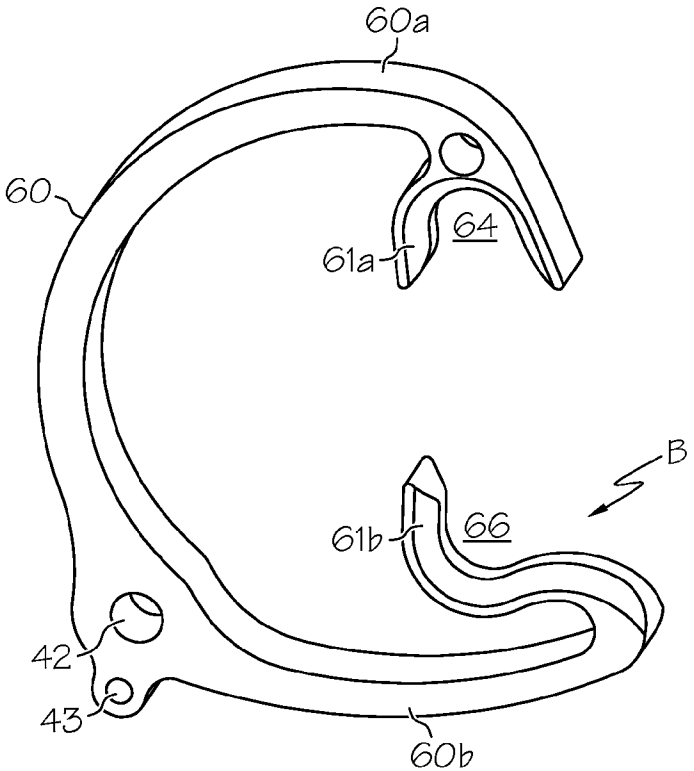
FIG. 8 is an elevational view of the second embodiment of the notched bracket of the releasable mount of the invention in which the notches face toward each other to exert a lower-stress inward force on the mounting posts when they are they are releasably mounted therein.

FIG. 8 shows a second embodiment of the mounting bracket 60 in which the lower notch 66 of the lower arm 60*b* of the mounting bracket 60 is configured such that the lower notch 66 forms first the entrance portion and then the final seating area in one continuous swept shape (see View "B"). In forming the lower notch 66 of the lower portion 60*b* of the bracket 60 in this manner, the maximum operating stress levels in the lower arm 60*b* are reduced below those in the lower arm 40*b* of the first embodiment of the mounting bracket 40. Such a design change could further improve the life expectancy of mounting bracket 60 over that of mounting bracket 40. In turn, mounting bracket 60 could be made from a material having ultimate material properties lesser than those required by the mounting bracket 40.

The first and second embodiments of the mounting brackets 40 and 60 retain the quiver 2 by trapping the mounting posts 70 between the inwardly facing notches 44/64 and 46/66 which, during mounting, first causes the upper and lower arms of the mounting bracket 40 and 60 to be spread apart until the posts 70 are received into the notches 44/64 and 46/66, whereupon the inherent resiliency of the mounting bracket 40 causes the notches 44/64 and 46/66 to exert a grasping force on the posts 70 positioned therebetween.

Figure 9:
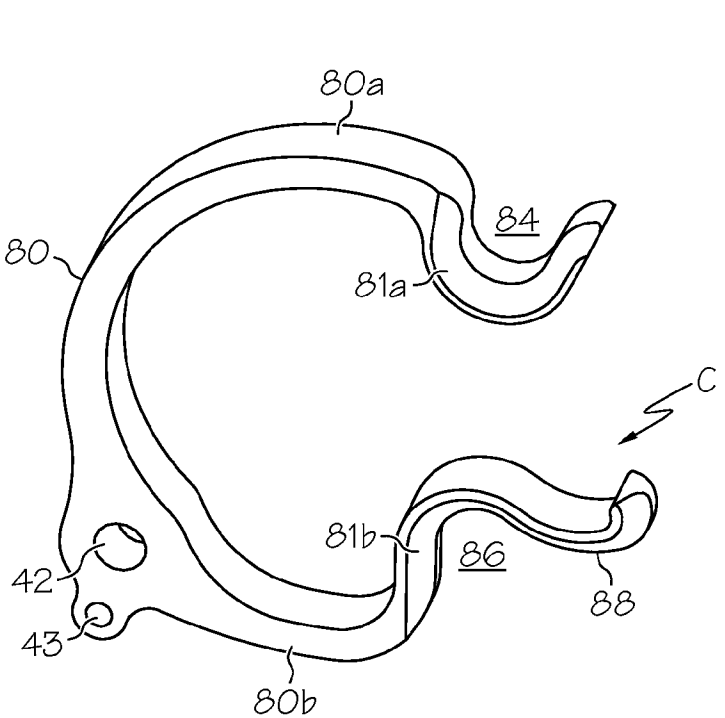
FIG. 9 is an elevational view of the third embodiment of the notched bracket of the releasable mount of the invention in which the notches face away from each other to exert an outward force on the mounting posts when they are they are releasably mounted therein.

In contrast, the third embodiment of the mounting bracket 80 as shown in FIG. 9, includes outwardly facing notches 84 and 86 that functions to exert an outward force onto the mounting posts 70 (in a reverse fashion when compared to the previous versions of mounting brackets 40 and 60). In this third embodiment, mounting the quiver 2 to the mounting bracket 80 involves positioning the upper mounting post 70 onto the upper notch 84 of the upper arm 80*a* such that the lower mounting post 70 is aligned with the lower notch 86 of the lower bracket arm 80*b*. The quiver 2 is then be rotated (clockwise relative to FIG. 9) bringing the lower post 70 into contact with surface 88 (see View "C"). Further clockwise movement forces the upper 80*a* and lower 80*b* arms of the mounting bracket 80 resiliently toward each other until the lower mounting post 70 engages into the lower notch 86. Once seated into their respective notches 84/86, the inherent resiliency of the mounting bracket 80 causes the upper and lower arms of 80*a* and 80*b* of the bracket 80 to apply outward pressure against two mounting posts 70, thereby capturing them therebetween and forming a positive attachment.

In each of the three embodiments, the quiver 2 may be released by forcing the quiver 2 away from the bow handle 1 with sufficient force to overcome the resilient force of the inherent memory of the material constituting the bracket 40/60/80 until the lower mounting post 70 snaps out from the lower notch 46/66/86. For additional ease in releasing, the arms of the bracket 40/60/80 may be forced outwardly (first and second embodiment) or inwardly (third embodiment) as the quiver 2 is forced away from the bow handle 1.

The present disclosure includes that contained in the appended claims, as well as that of the foregoing description. Although this invention has been described in its preferred form with a certain degrees of particularity, it is understood that the present disclosure of the preferred form has been made only by way of example and that numerous changes in the details of construction and the combination and arrangements of parts may be resorted to without departing from the spirit of the invention.

Now that the invention has been described:

The invention claimed is:

1. An archery bow accessory suitable for attaching to an archery bow, said accessory comprising:

an accessory body comprising a resilient mounting bracket; and a pair of mounting posts;

said resilient mounting bracket arranged to resiliently grasp said pair of mounting posts, said resilient mounting bracket being removable from said pair of mounting posts by resiliently deforming the resilient mounting bracket;

wherein said mounting posts are configured for attachment to said archery bow.

2. The archery bow accessory of claim 1, wherein said resilient mounting bracket forms a part of said accessory.

3. The archery bow accessory of claim 1, wherein a first portion of said bracket is arranged to engage one of said pair of mounting posts, a second portion of said bracket is arranged to engage the other of said pair of mounting posts.

4. The archery bow accessory of claim 1, wherein a first end of said bracket is arranged to engage one of said pair of mounting posts, a second end of said bracket is arranged to engage the other of said pair of mounting posts.

5. The archery bow accessory of claim 4, wherein a midportion of said bracket is arranged to be secured to either said archery bow or said accessory body.

6. The archery bow accessory of claim 1, said bracket comprising a first notch and a second notch.

7. The archery bow accessory of claim 6, said bracket further comprising a lead-in lip positioned next to said first notch, wherein an inflection is located between said first notch and said lead-in lip.

8. The archery bow accessory of claim 6, wherein said bracket is arranged to be removable from said posts by deforming said bracket such that the notches move toward one another.

9. The archery bow accessory of claim 6, wherein said bracket is arranged to be removable from said posts by deforming said bracket such that the notches move away from one another.

10. The archery bow accessory of claim 6, wherein one of said notches comprises an S-shape.

11. The archery bow accessory of claim 10, wherein at least one of said posts comprises a groove and said resilient mounting bracket comprises a complimentary ridge arranged to engage said groove.

12. The archery bow accessory of claim 1, wherein said resilient mounting bracket and said pair of mounting posts comprise complimentary wedging surfaces.

13. An archery bow comprising:

a riser;

an accessory comprising a resilient mount; and a first mounting post and a second mounting post;

wherein said mounting posts are attached to said riser said resilient mount arranged to resiliently grasp said first and second mounting posts, said resilient mount being removable from said mounting posts by resiliently deforming the resilient mount.

14. The archery bow of claim 13, wherein a first end of said resilient mount is arranged to engage said first mounting post, a second end of said resilient mount is arranged to engage the second mounting post and a midportion of said resilient mount is arranged to be secured to either said riser or said accessory.

15. The archery bow of claim 13, wherein said resilient mount comprises a first notch and a second notch, the first notch arranged to engage said first mounting post and the second notch arranged to engage said second mounting post.

16. The archery bow of claim 15, said resilient mount further comprising a lead-in lip positioned next to said second notch, wherein an inflection is located between said second notch and said lead-in lip.

17. The archery bow of claim 15, wherein one of said first and second notches comprises an s-shape.

18. The archery bow of claim 13, wherein said resilient mount and at least one mounting post comprise complimentary wedging surfaces.

19. The archery bow of claim 18, wherein at least one of said posts comprises a groove and said resilient mount comprises a complimentary ridge arranged to engage said groove.

* * * * *